US005247744A

United States Patent [19]

Ferris et al.

[11] Patent Number: 5,247,744

[45] Date of Patent: Sep. 28, 1993

[54] CONCEALED COMPARTMENT IN PICTURE FRAME

[76] Inventors: Michael L. Ferris; Lynne Ferris, both of P.O. Box 6948, Los Osos, Calif. 93412

[21] Appl. No.: 23,009

[22] Filed: Feb. 26, 1993

Related U.S. Application Data

[63] Continuation of Ser. No. 821,587, Jan. 16, 1992, abandoned.

[51] Int. Cl.[5] ..... G09F 1/12

[52] U.S. Cl. ..... 40/152

[58] Field of Search ..... 40/152, 152.1, 655; 312/204, 245

[56] References Cited

U.S. PATENT DOCUMENTS

| | | | |
|---|---|---|---|
| 1,502,137 | 7/1924 | De Foreest | 40/152 |
| 3,783,543 | 1/1974 | Hemgren | 40/152 |
| 4,729,183 | 3/1988 | Tarter et al. | 40/152 |

FOREIGN PATENT DOCUMENTS

| | | | |
|---|---|---|---|
| 361114 | 11/1931 | United Kingdom | 40/152 |
| 568168 | 3/1945 | United Kingdom | 40/152 |

*Primary Examiner*—Kenneth J. Dorner
*Assistant Examiner*—J. Bonifanti
*Attorney, Agent, or Firm*—Daniel C. McKown

[57] ABSTRACT

A picture frame that includes a concealed compartment includes three frame members connected at their ends to form a U-shaped structure and a fourth frame member that is unconnected to the three frame members and to which a picture-bearing panel is affixed, so that when the fourth frame member is removed, it carries with it the picture-bearing panel to reveal the compartment which previously had been concealed behind the picture-bearing panel. Inwardly facing grooves on opposite sides of the picture frame serve as guides for the edges of the picture-bearing panel as it is drawn away from the remainder of the picture frame.

1 Claim, 1 Drawing Sheet

CONCEALED COMPARTMENT IN PICTURE FRAME

REFERENCE TO RELATED APPLICATIONS

The present application is a continuation of U.S. Pat. application Ser. No. 07/821,587 filed Jan. 16, 1992 (now abandoned) for "Concealed Compartment in Picture Frame." Priority from Jan. 16, 1992 is claimed for the present application.

BACKGROUND OF THE INVENTION

1. Field of the Invention

The present invention is useful for concealing small objects such as keys, electrical switches, a thermostat or an electronic key pad, and externally has the appearance of a picture frame.

2. The Prior Art

A number of devices are known in the prior art for concealing objects in or behind a picture frame, but none of them has the structure of the present invention.

The following patents show picture frames that conceal compartments: U.S. Pat. No. 4,155,608 issued May 22, 1979 to Orlewicz; U.S. Pat. No. 4,304,447 issued Dec. 8, 1981 to Elwood et al.; U.S. Pat. No. 4,936,038 issued Jun. 26, 1990 to Johnson et al.; and U.S. Pat. No. 4,979,625 issued Dec. 25, 1990 to Johnson et al.

In U.S. Pat. No. 4,413,736 issued Nov. 8, 1983, Nibling shows a jewelry box to which a picture frame may be attached. The box includes a compartment for jewels.

In U.S. Pat. No. 4,261,122 issued Apr. 14, 1981, LeVine shows and describes a concealed compartment that lies between a planar picture backing and a picture frame backing member. Access to this compartment is obtained by pivoting one of the frame members rearwardly and outwardly as shown in FIG. 4 of the patent. Since the hinge axis lies on the rear of the frame, it appears that the back of the frame cannot be mounted flush against a wall if access to the compartment is required. In contrast, the frame of the present invention is intended to be mounted flush against a wall.

Even if the frame of Le Vine's patent is not mounted flush against a wall, obtaining access to the compartment appears to require one hand to keep the hinged frame member in the open position, another hand to slide the picture out, and possibly another hand to steady the remainder of the frame. In contrast, when the frame of the present invention is mounted to a wall, access to the concealed chamber can be obtained with only one hand.

In British Patent No. 361,114, Reimers describes a picture frame constructed in such a way as to permit the picture to be readily changed. Reimers does not suggest the possibility of providing a concealed compartment. Therefore it is not surprising that he does not provide sufficient space between his removable slide e and his cardboard wall b to accommodate objects that are to be concealed.

Even if a small object could be lodged in Reimer's picture frame, retrieving the object would be so difficult as to render the device useless. In Reimers the frame members a are glued to the cardboard back b. Consequently, the glass c cannot be removed without destroying the picture frame. Access to any stored object would be extremely difficult without breaking the glass.

In U.S. Pat. No. 1,502,137, De Foreest et al. nowhere suggest that they provide a concealed compartment, but instead they describe an identification tag holder for a vehicle. The tag holder somewhat resembles a picture frame having a metal backing plate 1 that is attached to a sheet metal portion 9 of the vehicle. The identification papers 24, protected from the front by a sheet of glass 16, are held against a metal plate 5 that is attached to an upper frame member 4, and inserted downwardly into the tag holder. Here the resemblance to the present invention stops, because in the invention of De Foreest et al., the inserted metal plate 5 includes a flange 6 that rides over and engages beneath locking tongues 7 on the backing plate 1, ". . . whereupon the parts will be automatically locked and the assemblage embodying the identification medium will be permanently housed within the holder. . .", thereby permanently preventing access to the space between the inserted metal plate 5 and the backing plate 1. In contrast, in the present invention, the upper frame member and the picture backing panel remain freely removable from the remainder of the picture frame, so that access to the concealed compartment can be obtained easily and with one hand.

So far as can be determined, the present invention includes novel structure that distinguishes it from other devices that are used for the same purpose.

SUMMARY OF THE INVENTION

In accordance with the present invention, there is provided a picture frame having four frame members, three of which are joined in the conventional manner while the fourth frame member is unconnected to and removable from the remaining three frame members. In use, the fourth frame member, which normally would be the top frame member, merely rests on the two side frame members when the frame is the closed position. A panel of rigid backing material, on which the picture is mounted, is affixed along one of its edges to the removable frame member. Thus, when the removable frame member is drawn away from the remaining three frame members, it carries with it the picture and the panel of backing material thereby revealing the concealed compartment.

The disguise is made very difficult to detect by the following technique. The three frame members that are connected form a U-shaped structure, and a U-shaped groove extends along the inwardly facing surfaces of these three frame members. The picture and its backing material fit into this groove in a loose sliding fit when the compartment is concealed by the picture, and the grooves guide the edges of the picture and backing material as they are being removed from the remainder of the frame.

As used herein the word "picture" includes (without limitation) paintings, photographs, and printed matter of all kinds including scenic, graphic and textual subject matter; in short, anything that can be displayed in a picture frame.

These and other aspects of the invention will be described more fully in connection with the drawing, which is intended solely for purposes of illustration and not by way of limiting the invention.

DETAILED DESCRIPTION OF THE PREFERRED EMBODIMENT

Figure 1:
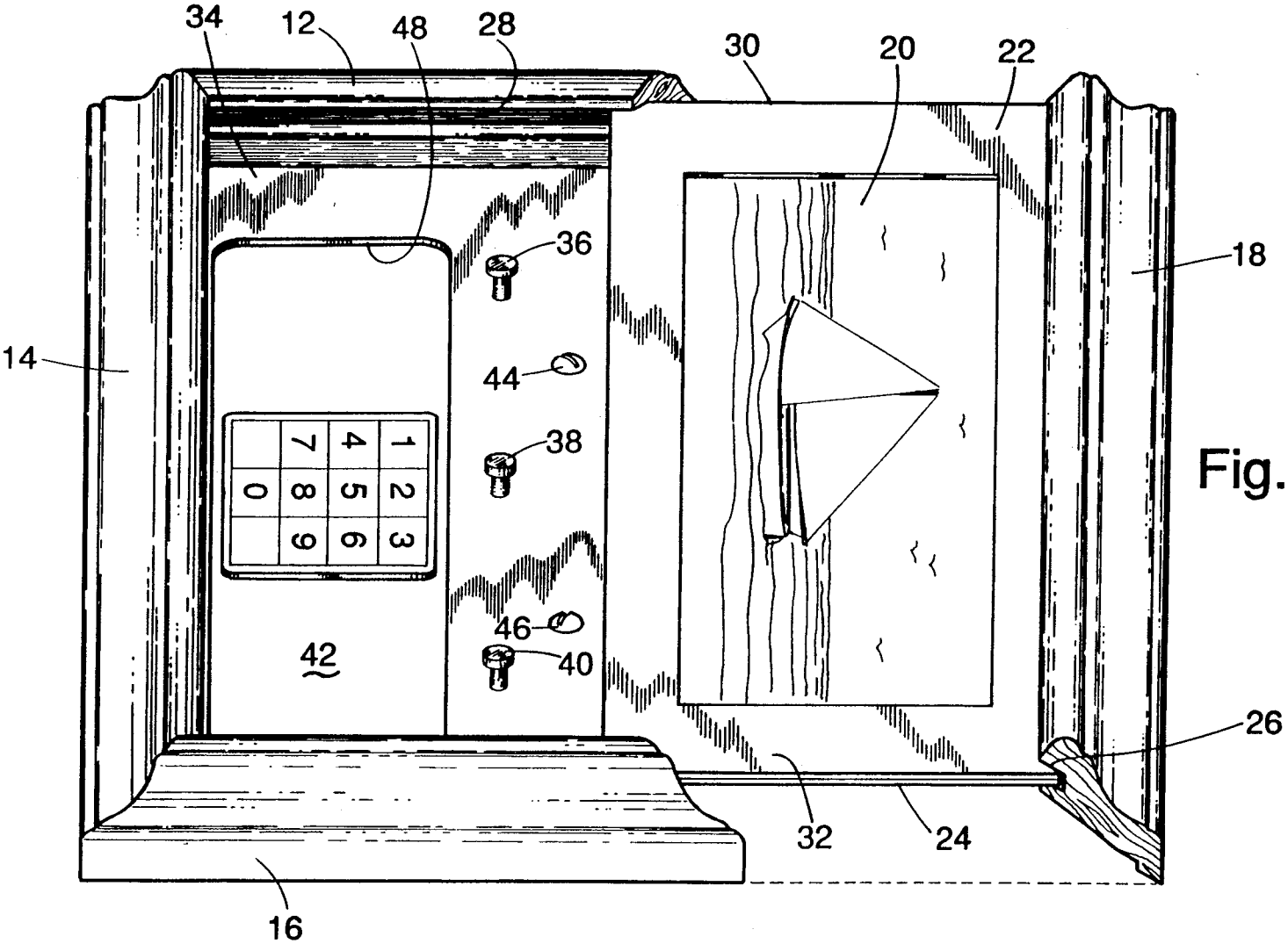

FIG. 1 is a perspective view showing a preferred embodiment of the invention in a partly-opened condition.

As can be seen in FIG. 1, the frame members 12, 14 and 16 are joined at their ends in the conventional way resulting in a three-sided structure that lies on a first imaginary plane which, in use, coincides with the wall 42.

The fourth frame member 18 is not connected to the frame members 12, 14, and 16, but instead is freely separable from them.

The picture 20 is sandwiches between a mat 22 and a stiff planar rectangular panel 24. In one alternative embodiment the mat 22 is omitted, and in another alternative embodiment, the picture is produced directly on the stiff planar rectangular panel 24.

In the preferred embodiment, the inwardly-facing edge of the fourth frame member 18 includes a groove 26 into which the sandwich composed of the picture 20, the mat 22, and the backing panel 24 extends and by which the sandwich is held permanently. In an alternative embodiment, the sandwich may be stapled or glued to the fourth frame member 18.

As a result, when the fourth frame member 18 is drawn away from the center of the frame, the picture 20, the mat 22, and the panel 24 of backing material are also pulled out of the picture frame, thereby revealing the secret compartment.

In the preferred embodiment, a U-shaped groove 28 extends along the inwardly facing surfaces of the frame members 12, 14, and 16. As shown in FIG. 1, the U-shaped groove 28 lies in a second imaginary plane, parallel to but spaced forward of the first imaginary plane referred to above. In an alternative embodiment, the groove 28 in the frame member 14 is omitted. Those portions of the groove 28 that are formed in the frame members 12 and 16 extend around the edges 30 and 32 of the picture and the panel of backing material 24 and serve as guides as the picture is removed from the frame. The overlapping of the mat 22 by the portion of the members 12 and 16 that are adjacent the groove 28 imparts the impression that the picture is permanently mounted in the frame.

In the preferred embodiment, a sheet 34 of backing material spans the underside of the frame members 12, 14, and 16. In the preferred embodiment, which follows conventional construction, the frame members are rabetted on their inwardly facing edge, and the backing material 34 is set into the rabet. In the preferred embodiment, several pegs 36, 38 and 40 are set into the backing material 34, and objects such as keys can be attached to the pegs. In the preferred embodiment, the concealed compartment is bounded at the rear by the backing material 34, at the front by the sandwich consisting of the picture 20, the mat 22, and the panel 24 of backing material, and is bounded on all four sides by the frame members 12, 14, 16, and 18.

In the preferred embodiment the sheet 34 of backing material is provided with an aperture 48 that permits access through the picture frame to wall-mounted equipment such as an electrical outlet, an electrical switch, a phone jack, a thermostat, an electronic touch pad (shown in FIG. 1), or other items that should not be tampered with by unauthorized persons.

In an alternative embodiment, the backing material 34 is omitted. When used without the backing material 34, the concealed compartment is bounded by the underside of the picture backing panel 24, the wall 42, and the frame members 12, 14, 16 and 18.

In the preferred embodiment shown in the drawing, the picture frame is mounted on a wall by screws 44, 46 that extend through the backing material 34 of the frame.

Thus, there has been described a picture frame that includes a concealed compartment that can be used for hiding objects. Access to the concealed compartment is obtained by drawing one of the picture frame members away from the center of the frame.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A picture frame comprising:

a bottom frame member extending horizontally and having a left end and a right end;

a right frame member;

a left frame member;

said left frame member and said right frame member affixed to and extending upward from the left end and the right end, respectively, of said bottom frame member;

said bottom frame member, said right frame member and said left frame member all lying on a first imaginary plane;

portions of said left frame member and of said right frame member defining parallel inwardly-facing grooves extending vertically in said left frame member and said right frame member, said parallel grooves lying in a second imaginary plane parallel to but spaced forward from the first imaginary plane sufficiently to accommodate objects that are to be concealed;

a top frame member of sufficient length to extend from the free end of said left frame member to the free end of said right frame member but not connected to either; and, a stiff planar rectangular panel having an upper edge that is affixed to said top frame member, and having left and right edges that extend in a loose sliding fit within the parallel inwardly-facing grooves of said right frame member and of said left frame member;

said stiff planar rectangular panel and said top frame member being unconnected to and freely removable from its closed position between, said right frame member and said left frame member;

the space behind said stiff planar rectangular panel between said right frame member and said left frame member and between said bottom frame member and said top frame member constituting the concealed compartment when said top frame member is resting on the free ends of the left and right frame members;

said concealed compartment opening into and directly accessible from a space directly in front of the picture frame when said stiff planar rectangular panel is removed from said parallel grooves.

* * * * *